US006666487B2

(12) United States Patent
Oxley et al.

(10) Patent No.: US 6,666,487 B2
(45) Date of Patent: Dec. 23, 2003

(54) POWER STRIKER WITH TOGGLE LINKAGE DRIVE MECHANISM

(75) Inventors: Peter Lance Oxley, Mount Albert (CA); Gordon Andrew Paton, Holland Landing (CA)

(73) Assignee: Atoma International Corp., Newmarket (CA)

( * ) Notice: Subject to any disclaimer, the term of this patent is extended or adjusted under 35 U.S.C. 154(b) by 0 days.

(21) Appl. No.: 10/203,974

(22) PCT Filed: Feb. 9, 2001

(86) PCT No.: PCT/CA01/00168

§ 371 (c)(1),
(2), (4) Date: Aug. 14, 2002

(87) PCT Pub. No.: WO01/63076

PCT Pub. Date: Aug. 30, 2001

(65) Prior Publication Data

US 2003/0011200 A1 Jan. 16, 2003

Related U.S. Application Data

(60) Provisional application No. 60/184,890, filed on Feb. 25, 2000.

(51) Int. Cl.[7] ..... E05B 65/12

(52) U.S. Cl. ..... 292/341.16; 292/144; 292/340; 292/341.15; 292/341.18

(58) Field of Search ..... 292/341.16, 341.15, 292/341.17, 341.18, 340, 144, DIG. 23; 49/279, 280; E05B 65/12

(56) References Cited

U.S. PATENT DOCUMENTS 2,851,296 A * 9/1958 Guyaz ..... 292/78
2,903,288 A 9/1959 Joachim
3,151,698 A * 10/1964 Pollock ..... 180/281
4,182,539 A * 1/1980 Busch ..... 312/333
4,211,443 A * 7/1980 Butts et al. ..... 292/341.16
4,613,176 A * 9/1986 Kelly ..... 292/201
4,913,475 A * 4/1990 Bushnell et al. ..... 292/144
5,707,092 A * 1/1998 Van Slembrouck et al. ..... 292/341.19
5,722,706 A * 3/1998 Bartel et al. ..... 292/216
6,010,168 A * 1/2000 Johnson ..... 292/341.17
6,050,116 A * 4/2000 Cole ..... 70/256
6,068,309 A * 5/2000 Jung et al. ..... 292/341.17

FOREIGN PATENT DOCUMENTS

DE 37 21 963 C 10/1988

* cited by examiner

*Primary Examiner*—William L. Miller
*Assistant Examiner*—Carlos Lugo
(74) *Attorney, Agent, or Firm*—Clark Hill PLC

(57) ABSTRACT

A power striker mechanism (10) has a housing (16) adapted for mounting on a vehicle. A striker assembly (12) is mounted to the housing and constrained to slide between an inboard and outboard position. An outer link (42) is pivotally attached to the striker assembly (12). An inner link (48) is pivotally attached to the housing (16) and pivotally attached to the outer link (42). A cinching mechanism (14) linkably connects the inner (48) and outer links (42). Driving movement of the cinching mechanism (14) effects the inboard and outboard movement of the striker assembly (12). The driving movement is generally perpendicular to the inboard outboard movement of the striker assembly (12) thereby isolating the cinching mechanism (14) from loads imparted to the striker assembly (12).

5 Claims, 4 Drawing Sheets

POWER STRIKER WITH TOGGLE LINKAGE DRIVE MECHANISM

This application claims benefit to provisional application No. 60/184,890 filed Feb. 25, 2000.

FIELD OF INVENTION

The subject invention relates to a power striker for use in a motor vehicle. In particular, this invention relates to a striker having an actuator for cinching a closure panel from an initial latched position to a final latched position.

BACKGROUND OF THE INVENTION

A vehicle closure panel, such as a door, typically includes a seal to prevent exterior environmental elements from intruding into a passenger compartment. The seal also reduces the amount of exterior noise transmitted into the passenger compartment. Seals with higher stiffness and greater seal pressures are being used to accommodate consumer demand for a quieter passenger compartment. In other words, new seals are becoming much stiffer than those traditionally used. As appreciated, a stiffer seal translates into an increase in force required to completely close the vehicle closure panel.

One solution to this problem is the use of a power striker. In one type of power striker, the latching mechanism of the vehicle closure panel latches to a striker mounted on the vehicle body. The closure panel is then closed to an initial closed position, the striker is then powered inboard by an actuator that cinches the closure panel to a final closed position.

One shortcoming of such a mechanism is its vulnerability to damage by slamming of the closure panel. A slamming closure panel damages the striker by driving the striker inboard of the vehicle. If the actuator is directly linked with the striker, the forces are exerted on the striker are transmitted through the drive mechanism to the actuator, damaging the actuator. Repair and replacement of these types of mechanisms is complicated due to the confined mounting locations required of such mechanisms.

SUMMARY OF INVENTION

The disadvantages of the prior art may be overcome by providing a power striker mechanism having a housing adapted for mounting on a vehicle. A striker assembly is mounted to the housing and constrained to slide between an inboard and outboard position. An outer link is pivotally attached to the striker assembly. An inner link is pivotally attached to the housing. A cinching mechanism linkably connects the inner and outer links. Driving movement of the cinching mechanism effects the inboard and outboard movement of the striker assembly. The driving movement is generally perpendicular to the inboard outboard movement of the striker assembly thereby isolating the cinching mechanism from loads imparted to the striker assembly.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
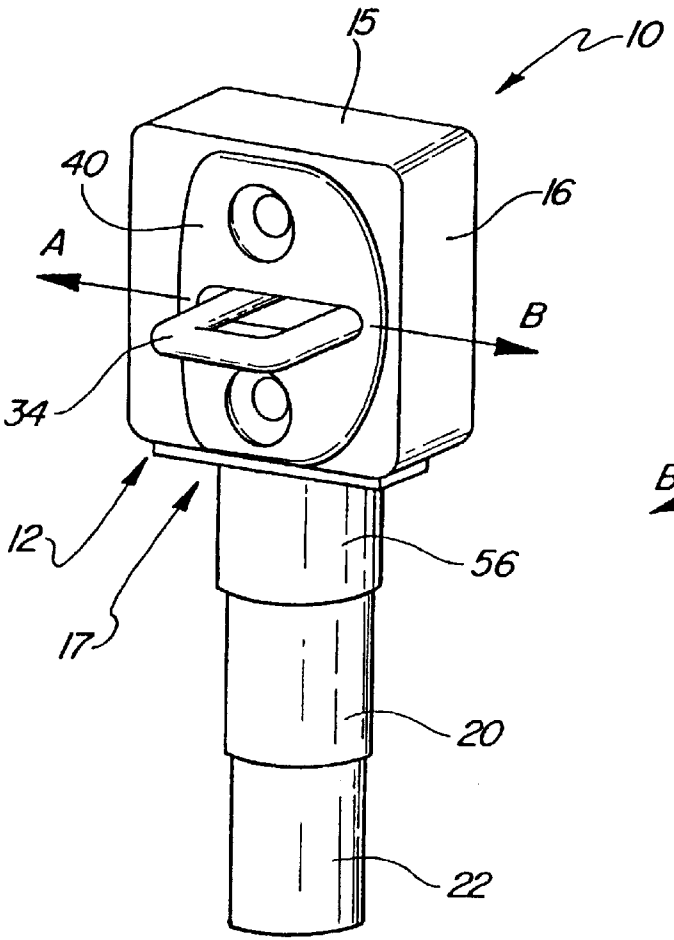
FIG. 1 is a perspective front view of a power striker mechanism of the present invention.

Referring to the Figures wherein like numerals indicate like or corresponding parts throughout the several views, a power striker mechanism is generally shown at 10 in FIG. 1.

The power striker mechanism 10 includes a striker assembly 12 disposed within a housing 16. The housing 16 has a top portion 15 and a bottom portion 17. The striker assembly 12 includes a striker loop 34 that extends through the housing 16. In particular, the striker loop 34 extends through a rectangular slot in a front side of the housing 16.

The striker loop 34 also extends through a rectangular slot in a cover plate 40 that attaches to the sheet metal of the vehicle once the striker is installed. The cover plate 40 provides a means for attaching a seal (not shown) between the vehicle body and the power striker mechanism 10.

As discussed in greater detail below, arrows A and B illustrate inboard and outboard directions of movement of the striker loop 34. As appreciated, the particular direction of the inboard and outboard movement is dependent on the orientation of the striker mechanism 10.

Attached to the bottom portion 17 of the housing 16 is a drive housing 56. Mounted to the drive housing 56 is a planetary gear box 20 and a motor or actuator 22. Motor 22 provides a driving rotation through gear box 20 to drive screw 18. Motor 22 and gear box 20 are conventional in design. Any suitable arrangement of motor and gear box will provide adequate results. Design criteria for a maximum seal load of 750 N requires a peak torque output of about 360 Nmm and for a maximum seal load of 1000 N requires a peak torque output of about 440 Nmm. It is well within the purview of those skilled in the art to provide a motor and gear box combination to produce the desired outputs.

In addition, the motor 22 could be mounted remotely from the housing 16 and operatively connected by a flexible drive cable which is commonly used in automotive applications.

Figure 2:
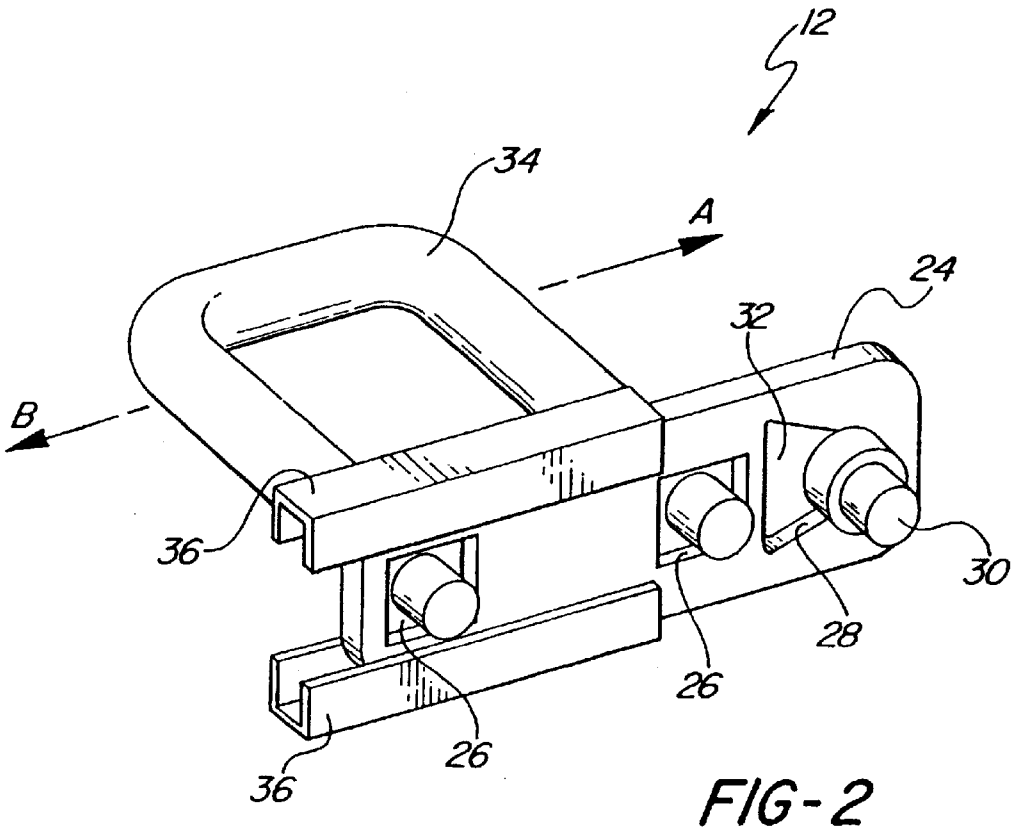
FIG. 2 is a perspective view of a striker assembly of the mechanism of FIG. 1.

Referring to FIG. 2, the striker assembly 12 comprises an elongate base plate 24 having a rectangular shape with two holes 26 disposed therein. The base plate 24 has a slot 28 in which a drive pin 30 is slidably mounted. The drive pin 30 is mounted in the slot 28 to allow slight inboard and outboard movement relative to the base plate 24. A resilient energy absorber 32 is mounted in the slot 28. The energy absorber 32 limits outboard movement of the drive pin 30 relative to the base plate 24 within the slot 28.

The striker loop 34 extends through the two holes 26 and attaches to the base plate 24 by any suitable fastener or attachment means. The base plate 24 is slidingly constrained by a pair of C-shaped slide bearings 36. The slide bearings 36 slidingly receive base plate 24 to allow only inboard movement as shown by arrow A, and outboard movement as shown by arrow B.

Figure 3:
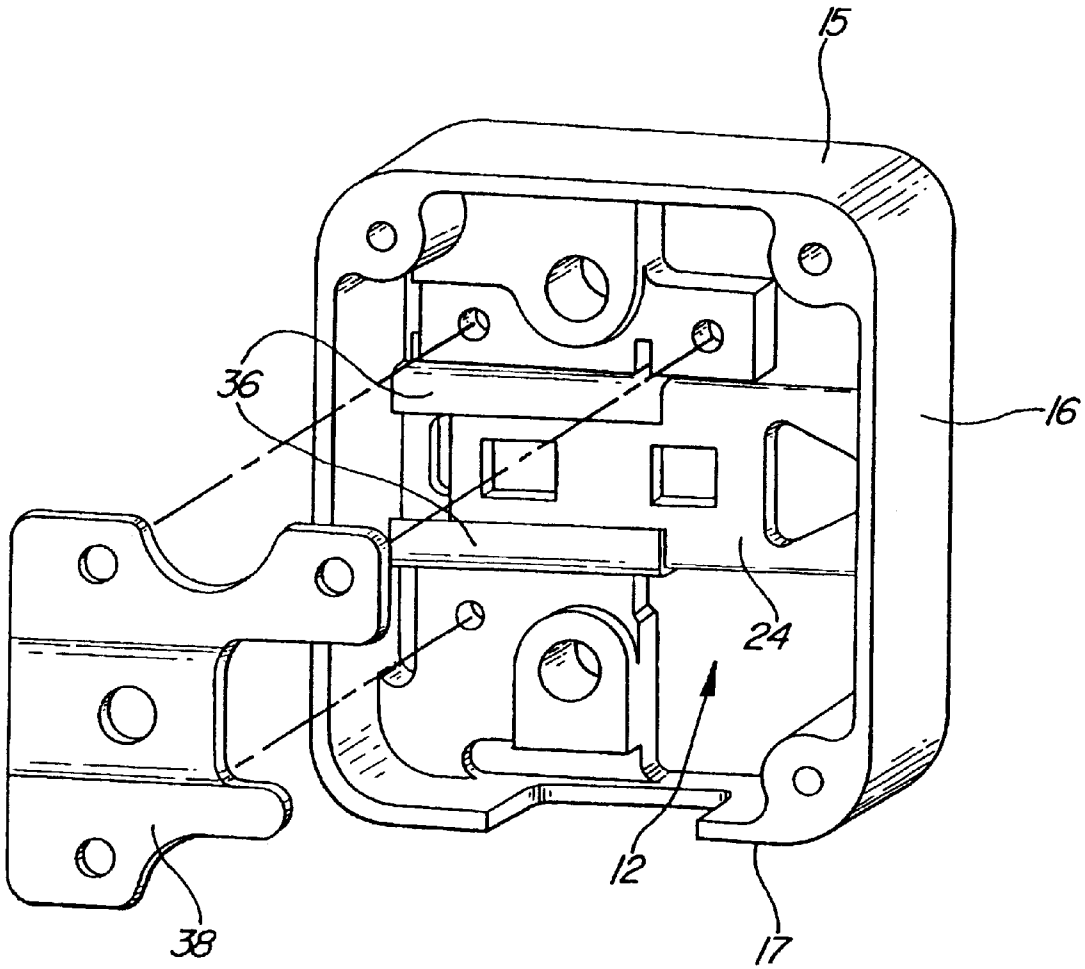
FIG. 3 is an exploded perspective rear view of the striker assembly of FIG. 2 mounted within a housing.

Referring to FIG. 3, the striker assembly 12 is shown mounted within the housing 16. The housing 16 is configured to receive slide bearings 36 and based plate 24. The striker assembly 12 is secured to the housing 16 by a retainer plate 38. The retainer plate 38 is secured within the housing 16 by three mounting screws (not shown).

Figure 5:
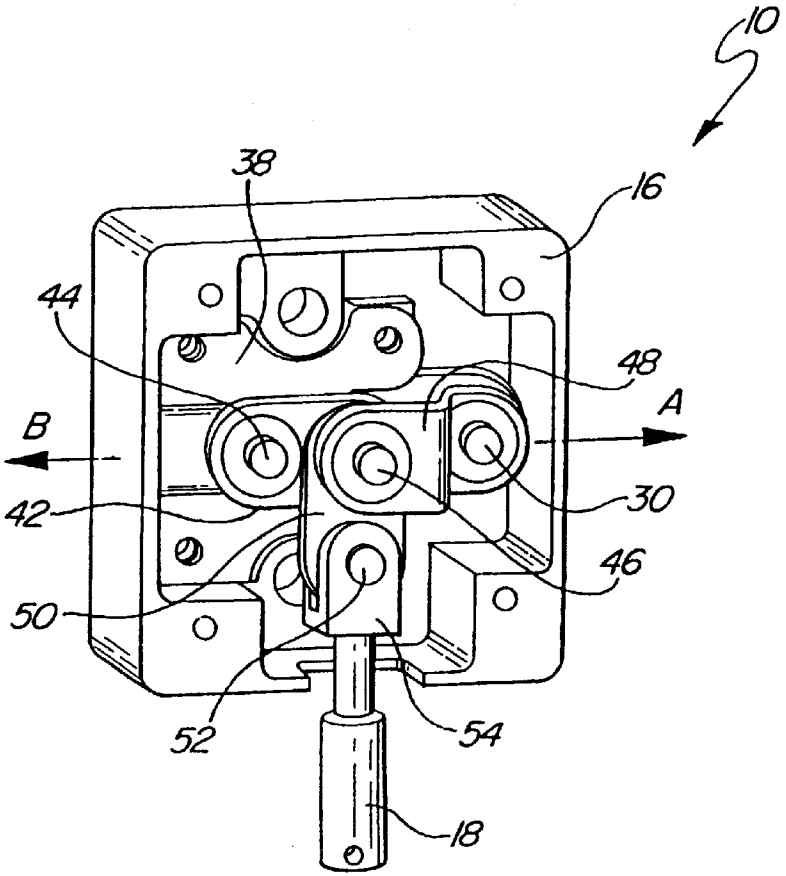
FIG. 5 is a perspective rear view of the power striker mechanism of FIG. 1 in a cinched position.
Figure 4:
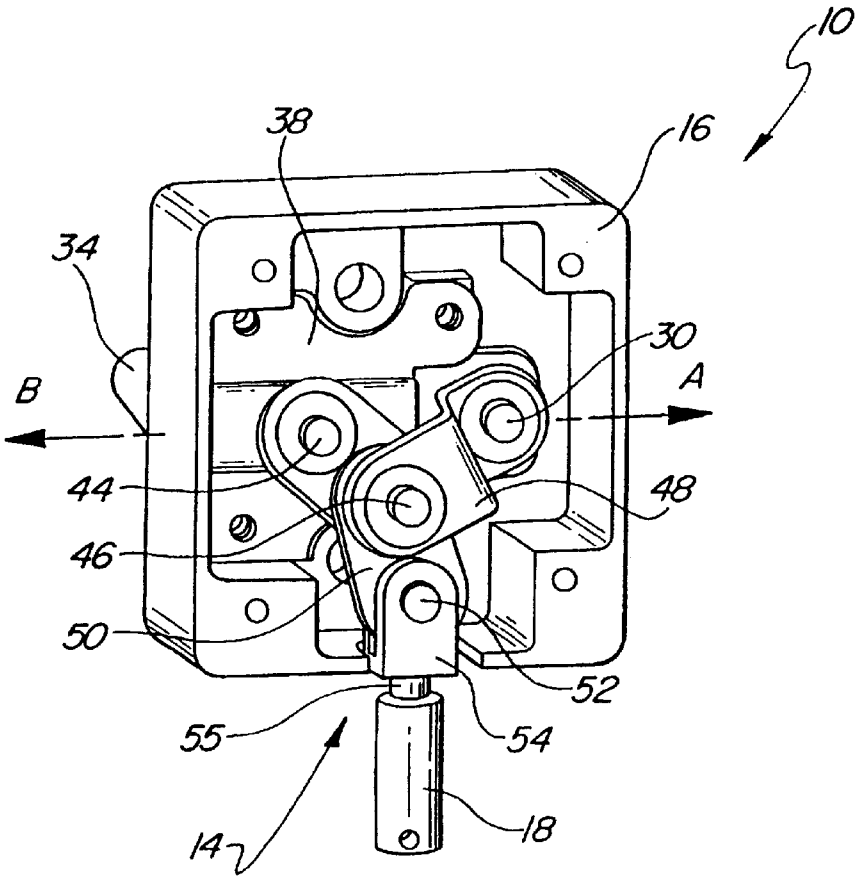
FIG. 4 is a perspective rear view of the power striker mechanism of FIG. 1 in an extended position.

Referring to FIGS. 4 and 5, the power striker mechanism 10 also includes a cinching mechanism 14 disposed within the housing 16 and operably connected to the striker assembly 12. The cinching mechanism 14 comprises an outer link 42 pivotally attached to the housing 16 at a pin 44, defining a second pivot. The retainer plate 38 provides a mounting point for the outer link 42.

An inner link 48 is pivotally attached at a first end to outer link 42 by connection pin 46 defining a third pivot and at a second end to the drive pin 30 defining a first pivot.

A driving link 50 is pivotally attached at a first end to the connection pin 46 and at a second end to a clevis 54 at a clevis pin 52. Clevis 54 has a shaft 55 which has an external thread.

Screw shaft 18 has a threaded bore in the end of the shaft. The clevis 54 threadingly engages into screw shaft 18. Rotation of the screw shaft 18 effects movement of the clevis 54. The motor 22, through gearbox 20, provides driving rotational movement of screw shaft thereby effecting movement of the clevis 54 in a direction perpendicular to the inboard and outboard movement. The screw shaft 18 is journal mounted within the drive housing 56 that supports the planetary gearbox 20. Threads (not shown) on the screw shaft 18 convert the rotary motion of the planetary gearbox 20 to linear vertical motion of the clevis 54. Screw shaft 18 also constrains the movement of the clevis 54 to linear movement.

As is now apparent to those skilled in the art, there are many existing methods of achieving linear motion of the clevis 54.

Referring in particular to FIG. 4, the striker loop 34 is in an outboard position (shown by arrow B) such that the driving link 50 is urged to a downward position by the clevis 54. The third pivot (connection pin 46) will be out of alignment with the first pivot (drive pin 30) and the second pivot (pin 44). In this outboard position, the linear distance between the fixed pin 44 and the drive pin 30 is at a minimum.

An impact of the vehicle closure panel on the striker loop 34 in the inboard direction (shown by arrow A) will be transmitted to the base plate 24 and partially absorbed by the energy absorber 32 positioned within the slot 28 before being transmitted to the drive pin 30. The energy absorber 32 dissipates much of the force exerted on the striker loop 34 by providing a pliant medium between the base plate 24 and the drive pin 30.

In other words, the resiliency of energy absorber 32 reduces the magnitude of impact forces transmitted into the cinching mechanism 14 from the slamming of the vehicle closure panel. Any remaining forces will be transmitted through the drive pin 30, to the inner link 48, and to the connection pin 46. Forces at the connection pin 46 will be further transmitted to both the outer link 42 and the driving link 50. Forces on the outer link 42 will be transmitted to the retainer plate 38 and further onto the vehicle body. Forces exerted onto the outer link will be transmitted through clevis pin 52 will not be transmitted into the planetary gearbox 20 due to the threaded engagement between the screw shaft 18 and the clevis 54. Specifically, back driving forces from the striker loop 34 will not enable the screw shaft 18 to rotate as a result of thread pitch selection of the threads on the screw shaft 18. The subject invention therefore protects the gears of the planetary gearbox 20 from the impact forces of a slamming closure panel.

Referring in particular to FIG. 5, the cinching mechanism 14 moves the striker loop 34 (hidden from view in FIG. 5) from the outboard position to an inboard position to pull the vehicle closure panel to a final closed or cinched position. Actuator 22 is energized to rotate the planetary gearbox 20 and the screw shaft 18. The screw shaft 18 drives the clevis 54 toward the top 15 of the housing 16. The movement of the clevis 54 pushes the connection pin 46 upward into alignment with the fixed pin 44 and the drive rivet 30. As appreciated, with the outer 42 and inner 48 links in alignment, the fixed pin 44 (the second pivot) and drive pin 30 (first pivot) will be at a maximum linear distance and in general alignment. With the closure panel in the fully inboard position, the cinching mechanism 14 locks the striker loop 34 into position. The energy absorber 32 within the slot 28 of the base plate 24 will absorb imparted inboard forces on the striker loop 34. Remaining forces will be transmitted to the vehicle body and will not be directed through the drive link 50.

As the inner 48 and outer 42 links come into alignment, the mechanical advantage becomes infinite. The use of this "toggle" mechanism is key to overcoming high seal forces with a relatively small power input motor.

Figure 7:
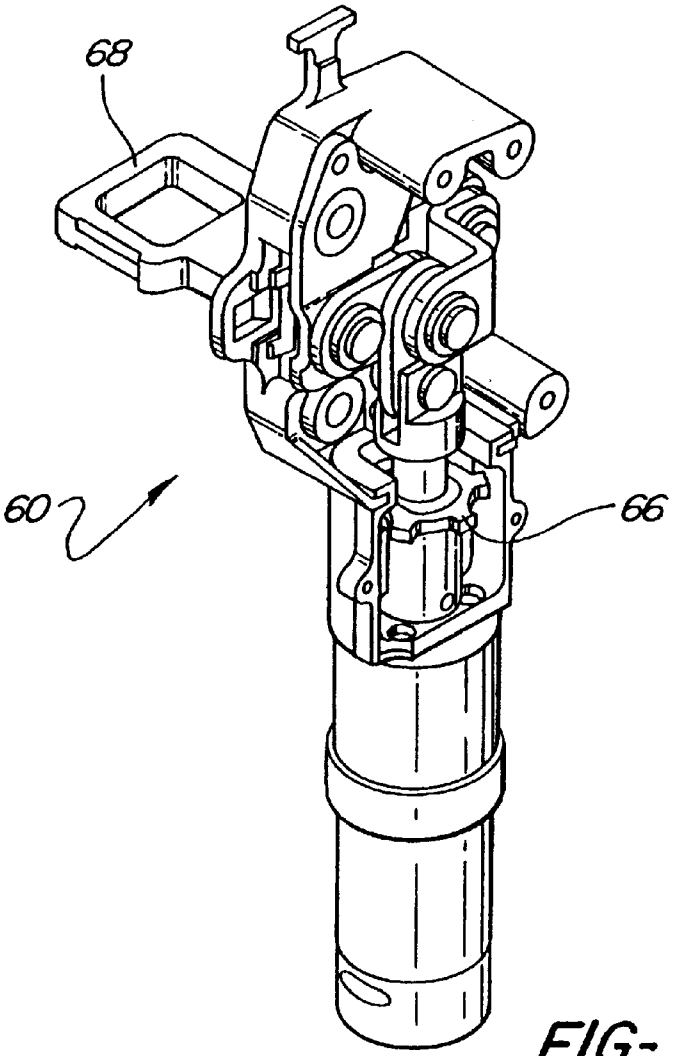
FIG. 7 is perspective rear view of the power striker mechanism of FIG. 6, with the rear plate removed.
Figure 6:
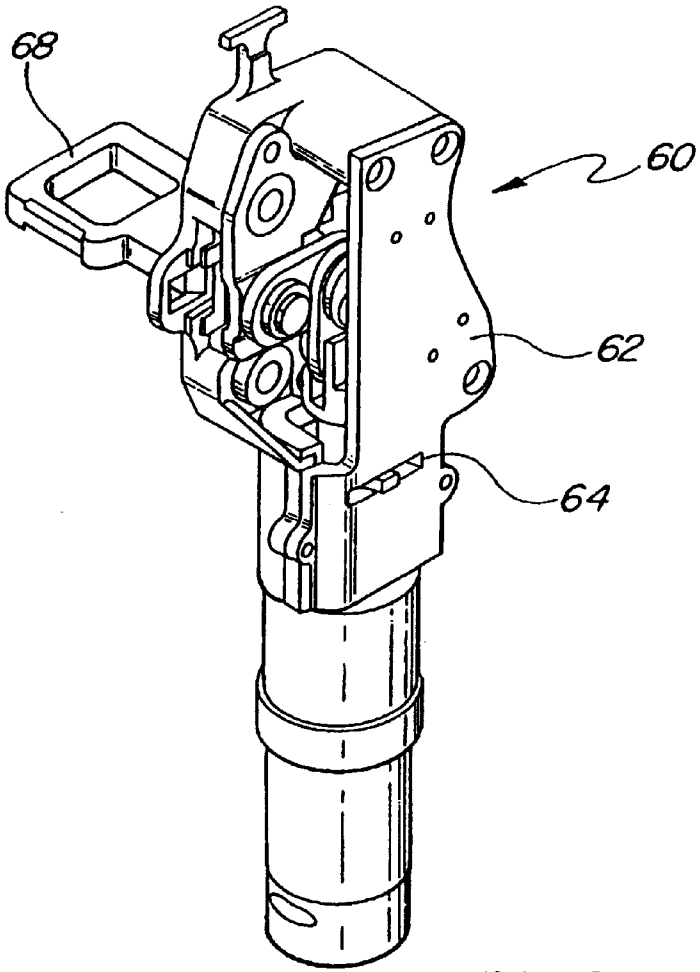
FIG. 6 is a perspective rear view of a power striker mechanism of a second embodiment.

Referring to FIGS. 6 and 7, a power striker mechanism 60 of a second embodiment of the present invention is illustrated. The second embodiment is identical to the first embodiment, except that the power striker mechanism has a thumbwheel 66 operatively mounted on the screw shaft 18. A rear plate 62 covers the rear of drive screw housing 56. Rear plate 62 has a slot 64 through which thumbwheel 66 extends. Manual rotation of the thumbwheel 66 effects the inboard and outboard movement of the striker loop 68. Optionally, the gear box of this embodiment can be provided with a clutch to allow counter rotation of the drive screw 18 and minimize back drive efforts.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that the invention may be practiced otherwise than as specifically described.

What is claimed is:

1. A power striker mechanism comprising:

a housing adapted for mounting on a vehicle;

a striker assembly slidably mounted to the housing for movement between an inboard and an outboard position;

an outer link pivotally attached to said striker assembly at a first pivot;

an inner link pivotally attached to said housing at a second pivot and pivotally attached to the outer link at a third pivot; and a cinching mechanism linkably connecting said inner and outer links at said third pivot wherein driving movement of said cinching mechanism effects said inboard and outboard movement of said striker assembly by toggling said third pivot into and out of alignment with said first and second pivots.

2. A power striker mechanism as claimed in claim 1 wherein said pivotal attachment of said outer link to said striker assembly has a resilient member interposed therebetween.

3. A power striker mechanism as claimed in claim 2 wherein said resilient member is positioned to absorb loads urging said striker assembly to move towards said inboard position.

4. A power striker mechanism as claimed in claim 1 wherein said cinching mechanism includes:

a drive link connected to said third pivot, a rod pivotally connected to said drive link, said rod constrained to move linearly in a direction generally perpendicular to said striker assembly movement, a drive shaft threadable engaging said rod, wherein driving rotation of said drive shaft responsively effects linear movement of said rod.

5. A power striker mechanism as claimed in claim 4 wherein said cinching mechanism includes a motor operatively engaging said drive shaft through a gear box.

* * * * *